US005651913A

United States Patent [19]

Lee

[11] Patent Number: 5,651,913

[45] Date of Patent: Jul. 29, 1997

[54] MODULAR FORM ASSEMBLY FOR CONCRETE STRUCTURE

[76] Inventor: Wen-Yuan Lee, 7F-3, No. 8, Lane 390, Sec. 1, Chien-Kang Rd., Tainan City, Taiwan

[21] Appl. No.: 374,307

[22] Filed: Jan. 18, 1995

[51] Int. Cl.[6] ..... E04G 17/04

[52] U.S. Cl. ..... 249/193; 249/47; 249/192; 249/196

[58] Field of Search ..... 249/47, 192, 193, 249/196

[56] References Cited

U.S. PATENT DOCUMENTS 4,901,497 2/1990 Lee ..... 52/582
4,957,272 9/1990 Lee ..... 249/196

*Primary Examiner*—Thomas R. Weber
*Attorney, Agent, or Firm*—Birch, Stewart, Kolasch & Birch, LLP

[57] ABSTRACT

A form assembly includes a pair of rows of clasp members mounted respectively on back sides of two form members thereof in alignment with each other. Each clasp member includes a horizontal section extending rearward from each form member, a vertical section projecting downward from a distal end of the horizontal section, and a hook section projecting forward from the vertical section for defining a hook groove. Each pair of aligned clasp members is provided with a T-shaped latch member which has two arm portions to engage the aligned clasp members, and a handle portion extending from and intermediately of the arm portions. Each arm portion has a polygonal cross-section, a first side, and a second side opposing the first side. The second side of each arm portion is insertable into and is pivotable within the hook groove when each arm portion is pressed against the horizontal section to engage frictionally the vertical section, thereby placing tightly each arm portion in the clasp member.

18 Claims, 8 Drawing Sheets

MODULAR FORM ASSEMBLY FOR CONCRETE STRUCTURE

BACKGROUND OF THE INVENTION

1. Field of the Invention

This invention relates to a form assembly, more particularly to a form assembly which has two rows of clasp members that are secured respectively to back sides of two adjacent form members and that are aligned with each other, and a plurality of substantially T-shaped latch members that engage respectively any two aligned clasp members so as to interconnect the form members.

2. Description of the Related Art

The improvement of this invention is directed to a conventional form assembly, as shown in FIG. 1, for forming a concrete structure. The conventional form assembly includes vertical form plates (A1), vertical backing frames (A2), and horizontal reinforcement channel members (A3) which are coupled detachably to one another and which are then attached detachably to upper and lower edges of the form plates (A1). The backing frames (A2) are mounted detachably between the horizontal reinforcement channel members (A3) behind the form plates (A1).

Referring to FIGS. 2 and 3, in order to interconnect two adjacent vertical form plates (A11, A12), the conventional form assembly, when in practical application, further includes a fastener which has been disclosed in U.S. Pat. No. 4,901,497, and which includes two looped members (A41, A42) and a key member (A5).

The looped members (A41, A42) project respectively from back faces of the form plates (A11, A12) along their longitudinal sides, and are aligned with each other. Each of the looped members (A41, A42) has an engagement face which is spaced from the back face of a respective one of the looped members (A41, A42), and two opposed flanks which extend from two sides of the engagement face and which are connected to the back face. The distance between the flanks is greater than that between the engagement face and the back face.

The key member (A5) has an insert rod portion (A51) to be inserted into the aligned looped members (A41, A42), and a handle rod portion (A52) which forms an angle with the insert rod portion (A51). The insert rod portion (A51) has a pair of first opposed longitudinal faces (A53) and a pair of second opposed longitudinal faces (A54). The distance between the first opposed faces (A53) is smaller than the distance between the engagement face and the back face so that the insert rod portion (A51) can be inserted into the aligned looped members (A41, A42). The distance between the second opposed faces (A54) is greater than the distance between the engagement face and the back face so that the second opposed faces (A54) engage respectively the engagement face and the back face when the insert rod portion (A51) is turned by a predetermined angle after being inserted.

Referring to FIG. 4, when applied to form culverts, tunnels or the like, the conventional form assembly further includes several insert form pieces (A73) which are installed respectively between any two adjacent form plates (A71, A72) so as to constitute a collapsible core form (A7) that is applied to the inner surface of the formed concrete wall (A6) and that can be stripped from the same by removing the insert form pieces (A73) from the adjacent form plates (A71, A72) in a known manner. However, since the dimension of the insert form pieces (A73) is relatively small in comparison with that of the form plates (A71, A72), it is quite inconvenient to employ the fastener, which has been used to interconnect the form plates (A71, A72), to fasten the insert form pieces (A73) to the form plates (A71, A72).

SUMMARY OF THE INVENTION

Therefore, the main objective of the present invention is to provide a form assembly which includes two rows of clasp members that are secured respectively to back sides of two adjacent form members and that are aligned with each other, and a plurality of substantially T-shaped latch members that engage respectively any two aligned clasp members so as to interconnect the form members.

Another objective of the present invention is to provide a form assembly which further includes an insert form piece which can be installed contiguously and firmly between the adjacent form members by means of the engagement of the clasp members and the latch members.

According to the invention, a form assembly includes at least two vertical form members held together in a common plane. Each of the form members includes a concrete forming front side, an opposite back side, and a vertical side interconnecting the front and back sides. The form assembly further includes two roars of clasp members mounted respectively on the back sides of the form members along the vertical sides and aligned horizontally with each other, and a plurality of substantially T-shaped latch members mounted respectively to the aligned clasp members.

Each of the clasp members is an L-shaped member which includes a horizontal section that extends rearwardly from the back side of each of the form members, a vertical section that projects downwardly from a distal end of the horizontal section, and a hook section that projects forwardly from the vertical section for defining a hook groove. Each of the clasp members has two arm portions that engage respectively the aligned clasp members, and a handle portion that extends from and intermediately of the arm portions.

Each of the arm portions has a polygonal cross-section, a first side opposing the handle portion, and a second side opposing the first side. The second side of each of the arm portions is insertable into and is pivotable within the hook groove of the corresponding clasp member when each of the arm portions is pressed against a bottom side of the horizontal section of the corresponding clasp member, and finally engages frictionally the vertical section of the corresponding clasp member, thereby placing tightly each of the arm portions in a respective one of the clasp members.

In addition, the form assembly further includes an insert form piece with an insert part to be inserted between the form members in an edge-to-edge contiguity, and a back part covering a rear face of the insert part. The back part has a width larger than that of the insert part and extends over portions of the back sides of the form members. The back part engages frictionally the first sides of the arm portions, thereby holding tightly the insert form piece between the form members.

BRIEF DESCRIPTION OF THE DRAWINGS

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
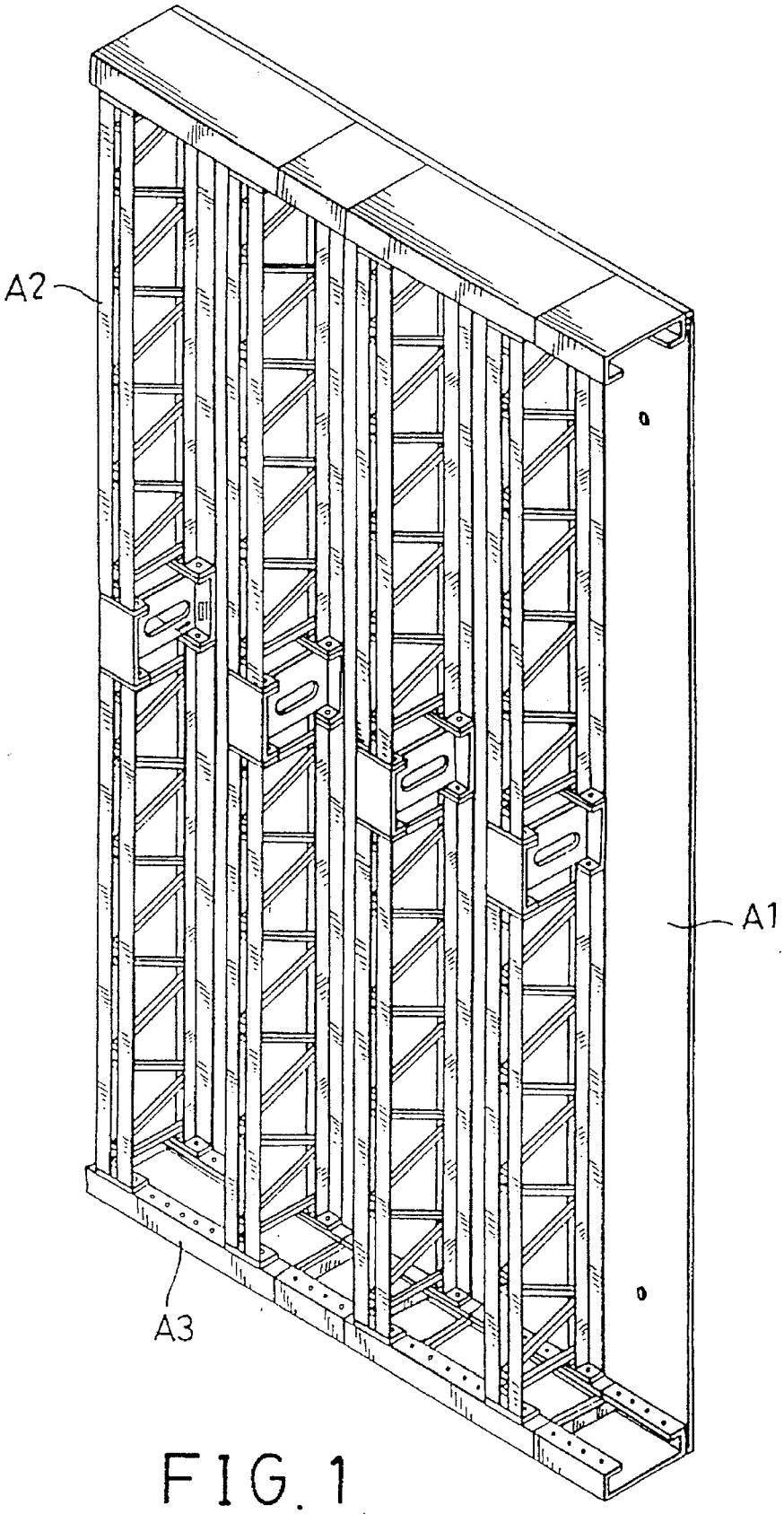
FIG. 1 (PRIOR ART)
FIG. 1 is a perspective view of a conventional form assembly.
Figure 2:
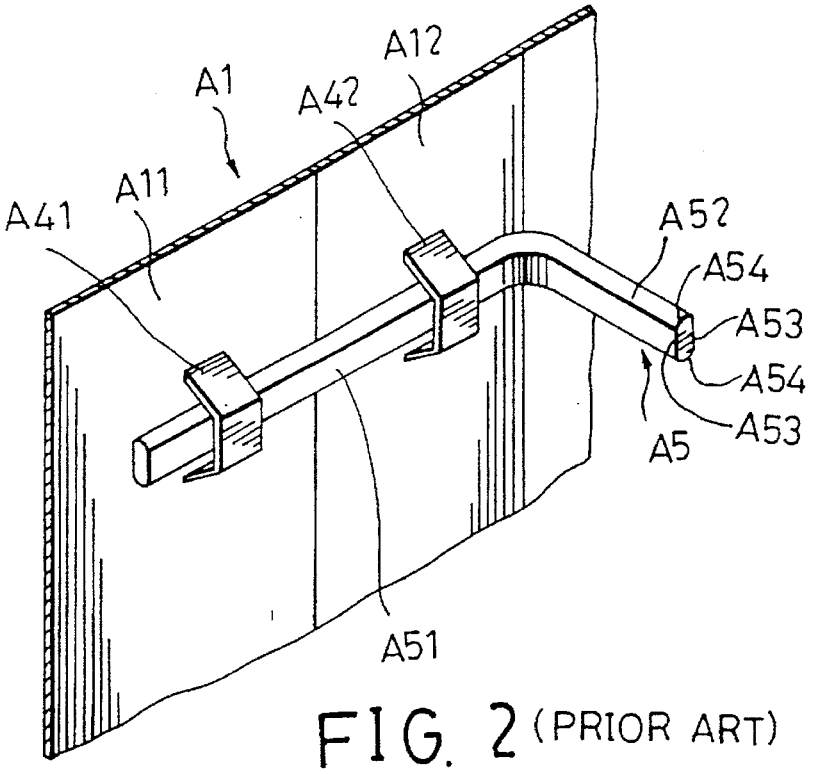
FIG. 2 (PRIOR ART)
FIG. 2 is a perspective view showing a fastener of the conventional form assembly.
Figure 3:
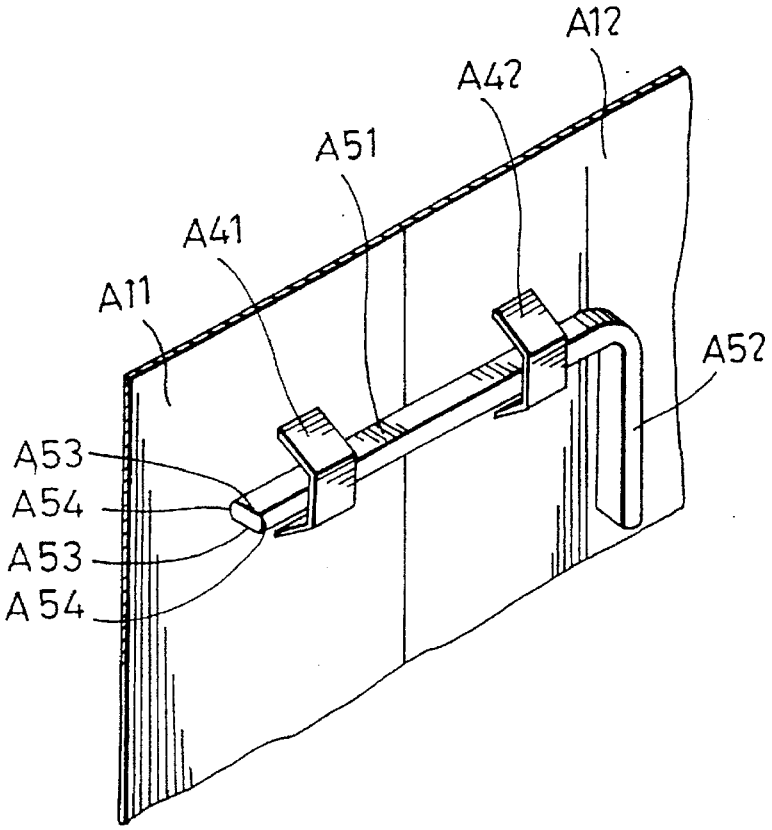
FIG. 3 (PRIOR ART)
FIG. 3 is a schematic view illustrating how the fastener of the conventional form assembly is operated to interconnect two adjacent form plates of the conventional form assembly.
Figure 4:
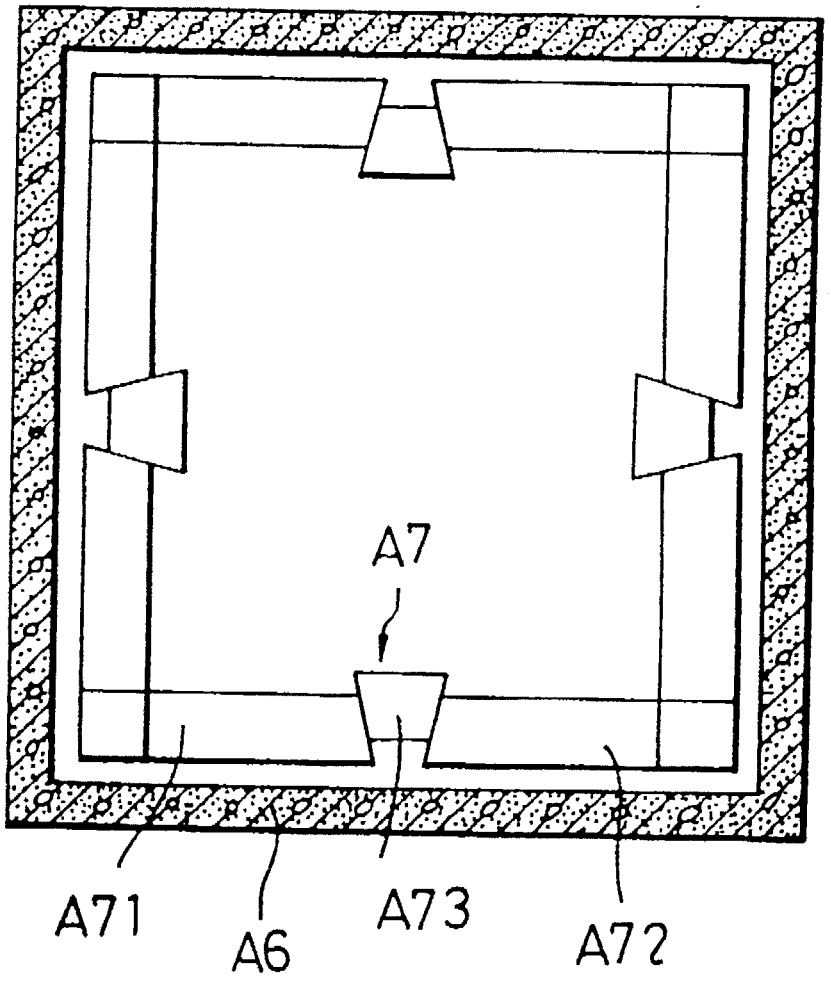
FIG. 4 (PRIOR ART)
FIG. 4 is a schematic view illustrating how a collapsible core form of the conventional form assembly is stripped from an inner surface of a formed concrete wall.
Figure 5:
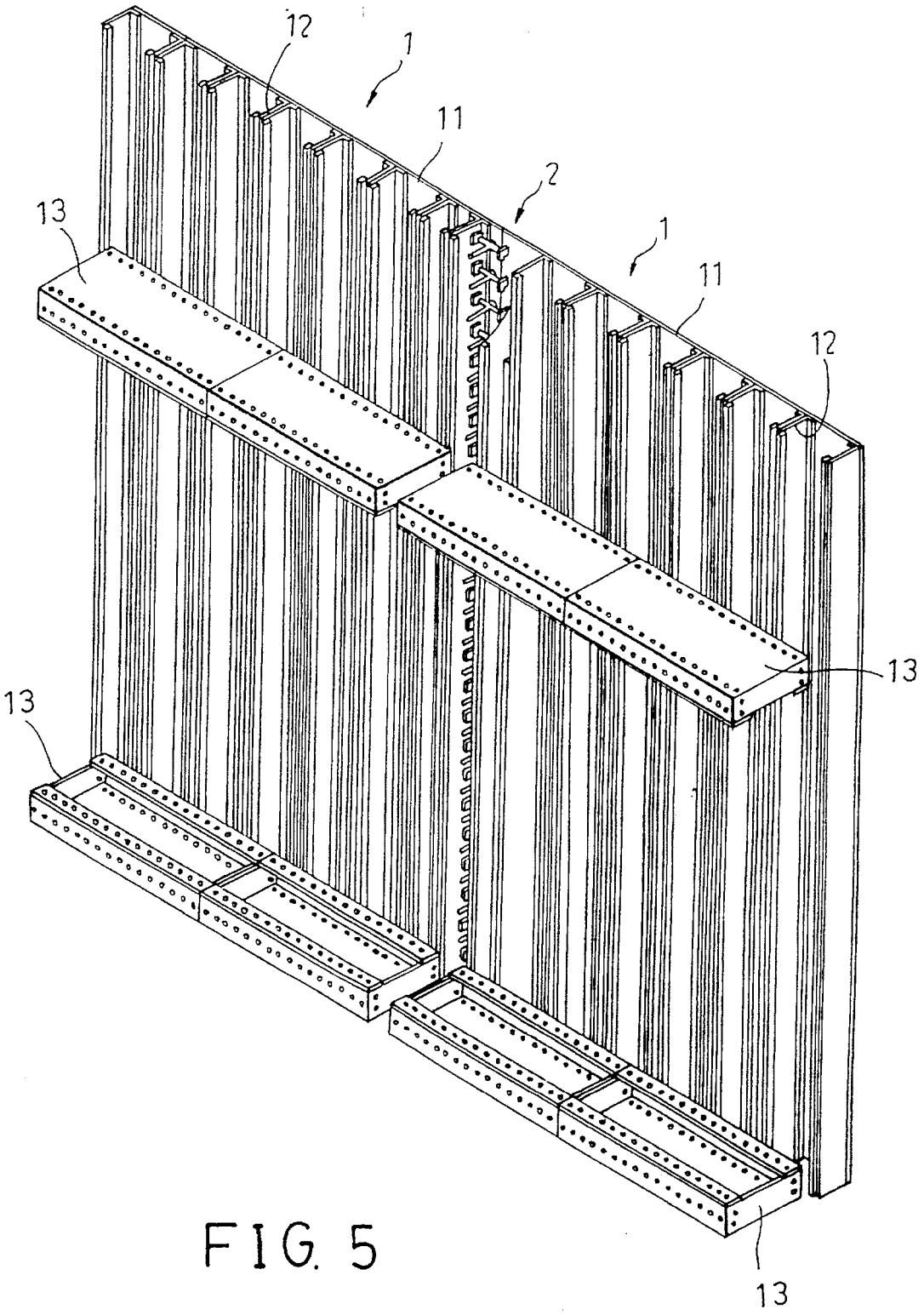
FIG. 5 is a perspective view showing the first preferred embodiment of a form assembly of this invention.

Referring to FIG. 5, the first preferred embodiment of a form assembly 1 according to this invention includes at least two vertical form members 11 which are held together in a common plane by means of a fastening device 2. Each of the form members 11 has a concrete forming front side, an opposite back side, and two vertical sides interconnecting the front and back sides. The form assembly 1 further includes a plurality of vertical reinforcing plates 12 which are mounted securely to the back sides of the form members 11 in a known manner, and a plurality of horizontal reinforcing channel pieces 13 which are coupled detachably to one another and then attached detachably to the reinforcing plates 12 opposite to the form plates 11 in a known manner. In addition, two adjacent vertical sides of the form members 11, as shown in FIG. 6, are formed with rearwardly inclined edge surfaces 14.

Figure 6:
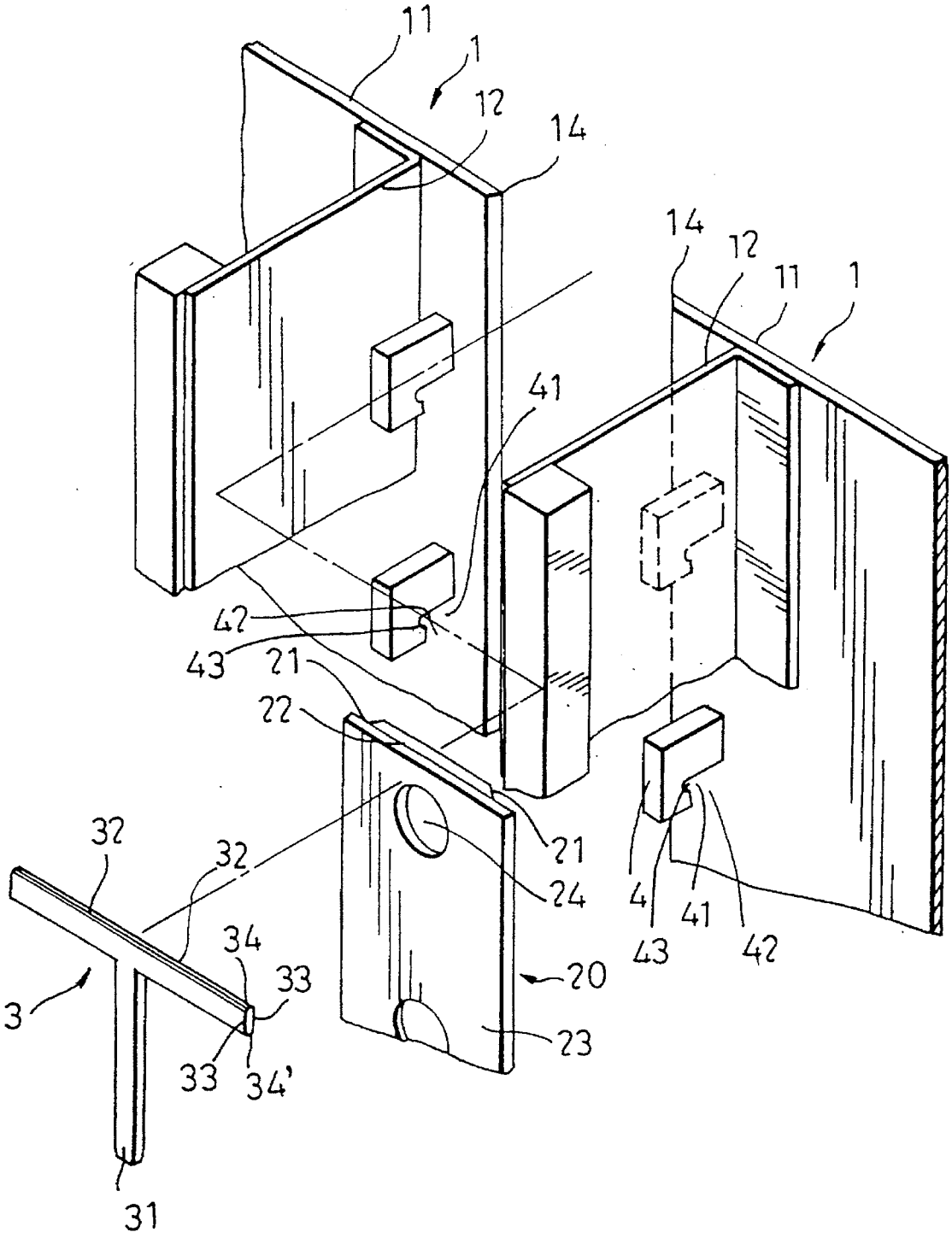
FIG. 6 is an exploded view showing the form assembly of this invention.
Figure 7:
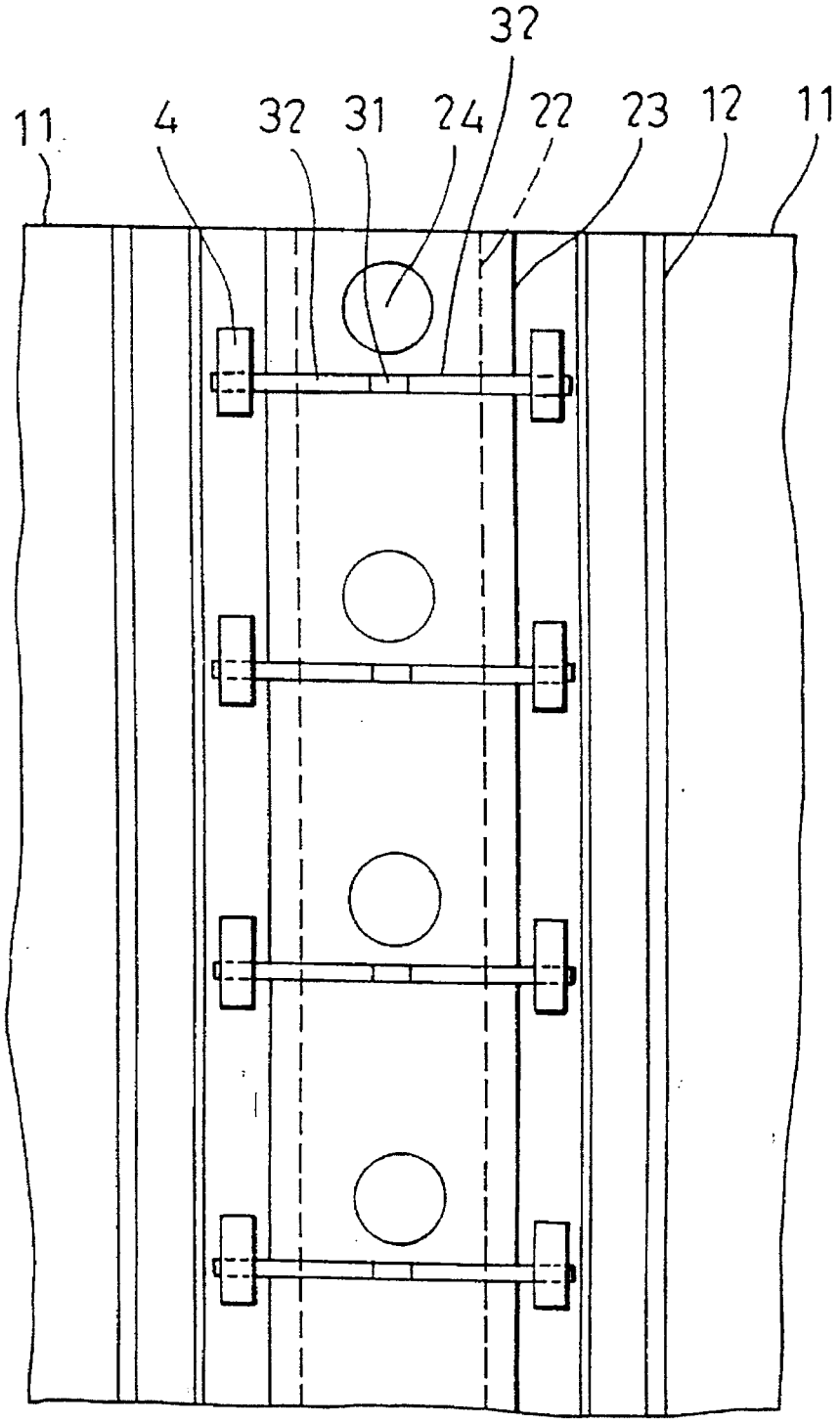
FIG. 7 is a schematic view illustrating the connection of the form assembly in accordance with this invention.

Referring to FIGS. 6 and 7, two rows of clasp members 4 which are mounted respectively to the back sides of the form members 11. The clasp members 4 extend along the vertical sides of the form members 11, and are aligned horizontally with each other. Each of the clasp members 4 is an L-shaped plate which has a horizontal section that projects rearwardly front the back side of the corresponding form member 11, a vertical section that projects downwardly from a distal end of the horizontal section so as to define a receiving space 41 between a front face of the vertical section and the back side of the corresponding form member 11, and a hook section that projects forwardly from a lower end of the vertical section so as to define an opening 42 between the hook section and the form member 11 beneath the receiving space 41. In this way, a hook groove 43 is defined among the horizontal, vertical and hook sections of the clasp member 4. It is noted that the width of the opening 42 is smaller than that of the receiving space 41.

Figure 8:
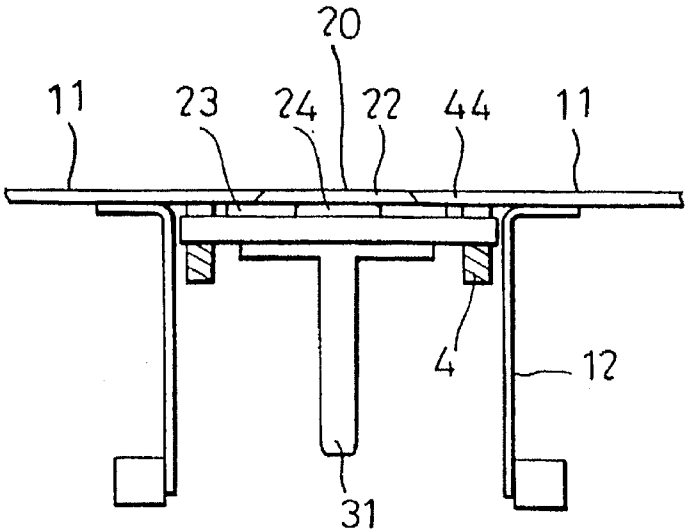
FIG. 8 is an elevational top view showing the form assembly of this invention.

An insert form piece 20 includes an insert part 22 which is an elongated vertical plate, and a plate-like back part 23 which is attached securely to a rear side of the insert part 22 by welding. The back part 23 has several holes 24 formed therethrough. Thus, the back part 23 can be welded to the insert part 22 at the areas where the inner peripheral edges around the holes 24 meet the rear side of the insert part 22. This provides a convenient and effective way of welding the insert and back parts 22 and 23 together. The insert part 22 can be inserted between the form members 11, and has two inclined longitudinal edge surfaces 21 that abut respectively against the inclined edge surfaces 14 of the form members 11 when the insert part 22 is coupled with the form members 11 so as to arrange the insert part 22 and the form members 11 in an edge-to-edge contiguity and in a common plane, as shown in FIG. 8. In addition, the back pare 23 has a width larger than that of the insert part 22 and extends over portions of the back sides of the form members 11 in order to cover clearances between the insert part 22 and the form members 11.

Figure 9:
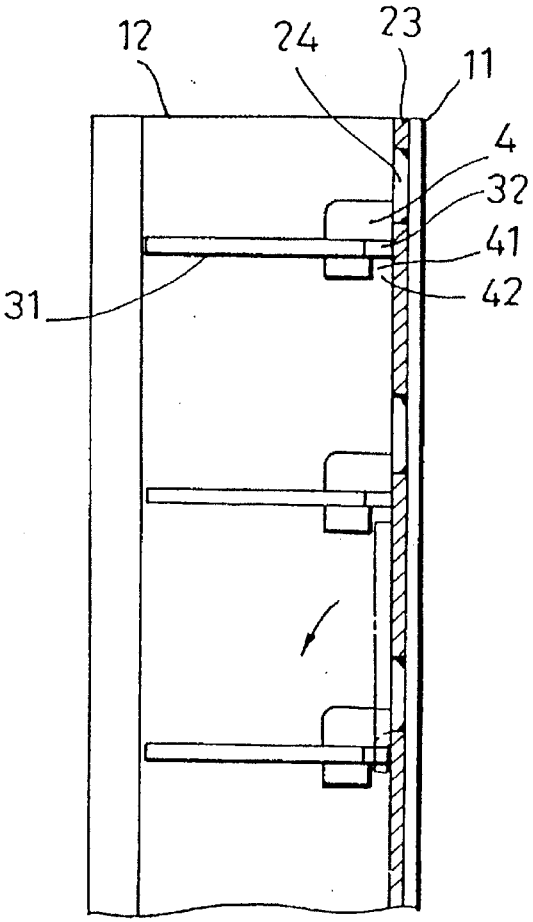
FIG. 9 is an elevational side view showing the form assembly of this invention.

Referring again to FIGS. 6 and 7, the fastening device 2 further includes a plurality of substantially T-shaped latch members 3 which are installed respectively and detachably no any two aligned clasp members 4. Each of the latch members 3 has two arm portions 32 that engage respectively the aligned clasp members 4, and a handle portion 31 extending from and intermediately of the arm portions 32 for operating the latch member 3. Each of the arm portions 32 has a quadrilateral cross-section, a first side 34 opposing the handle portion 31, a second side 34' opposing the first side 34, and two opposite third sides 33. The distance between the third sides 33 is smaller than the width of the opening 42 so that the second side 34' can be inserted into the hook groove 43 of the corresponding clasp member 4 via the opening 42. Then, the handle portion 31 is operated downwardly to a horizontal position, as shown in FIGS. 8 and 9, so as to allow the third sides 33 of the arm portions 32 of the latch member 3 to press respectively against bottom sides of the horizontal sections of the aligned clasp members 4. The distance between the first and second sides 34, 34' is almost equal to that of the width of the receiving space 41. Thus, the second sides 34' of the arm portions 42 of the latch member 3 can engage respectively the front faces of the vertical sections of the aligned clasp members 4 when the handle portion 31 is turned to its horizontal position after the arm portions 32 of the latch member 3 are inserted into the receiving spaces 41 of the aligned clasp members 4. At the same time, the first sides 34 of the arm portions 32 of the latch member 3 can engage frictionally the rear surface of the back part 23, thereby holding tightly the insert form piece 20 between the form members 11 to constitute a common form plane.

Figure 10:
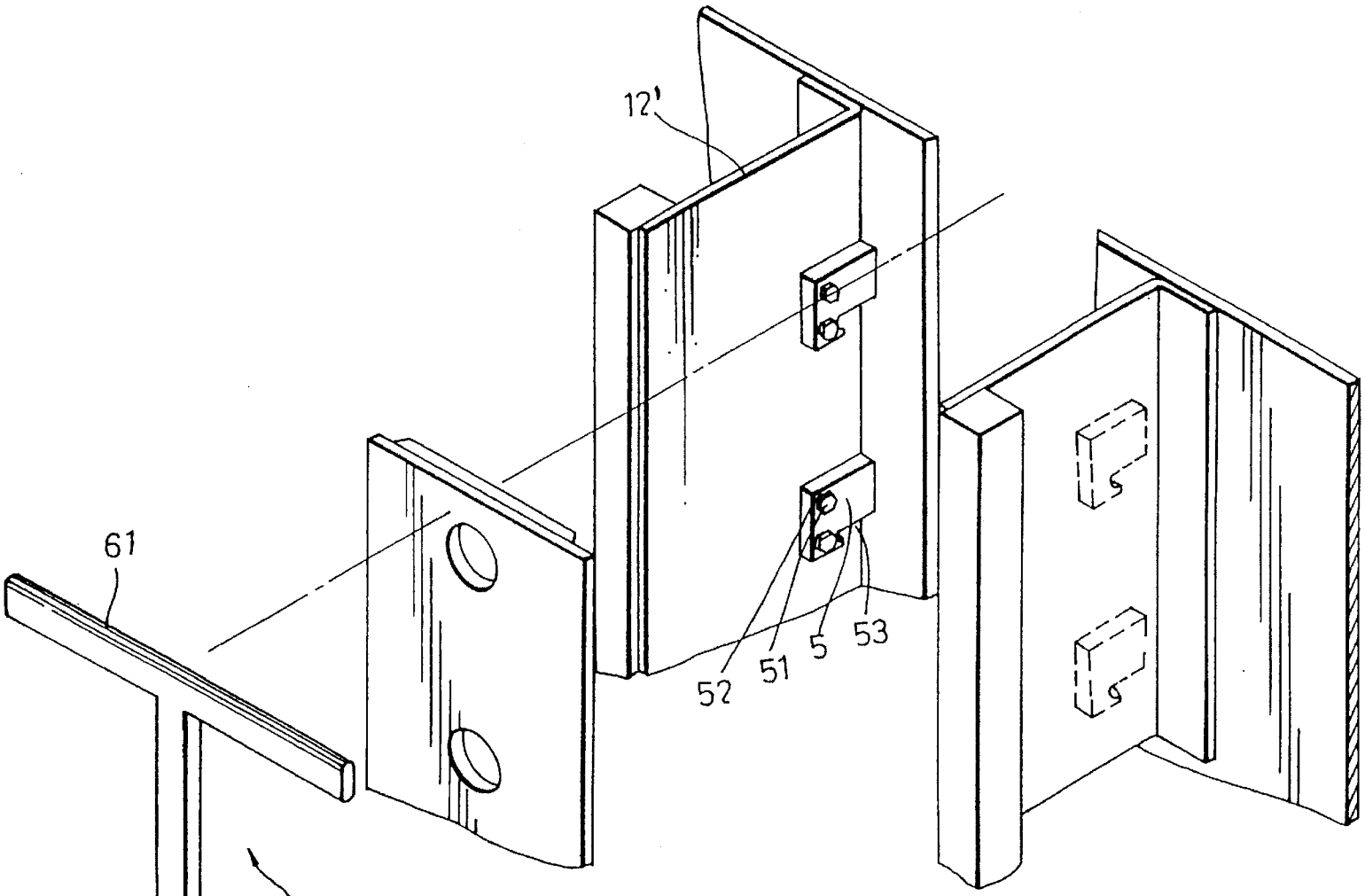
FIG. 10 is an exploded view showing the second preferred embodiment of a form assembly of this invention.

FIG. 10 shows modified clasp members 5 of the second preferred embodiment of a form assembly according to this invention. As shown, each of the clasp members 5 is mounted securely on a respective one of the vertical reinforcing plates 12' by means of a bolt 51 which extends through a hole 52 of the clasp member 5 to engaged the corresponding vertical reinforcing plate 12'.

Owing to the presence of the clearance between the bolt 51 and an inner peripheral face of the clasp member 5 which confines the hole 52, the clasp member 5 can be moved slightly rearwardly, when each of the arm portions 61 of the latch member 6 engages a respective one of the aligned clasp members 5, in order to facilitate turning of the arm portions 61 of the latch member 6 within the receiving spaces 53 of the aligned clasp members 5.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangement.

I claim:

1. A form assembly comprising:

at least two vertical form members held together in a common plane, each of said form members including a concrete forming front side, an opposite back side, and a vertical edge;

pairs of clasp members mounted respectively on said back sides of said form members along said vertical edges, said clasp members of each pair being aligned horizontally with each other, each of said clasp members being an L-shaped member which includes a horizontal section that extends rearwardly from said back side of each of said form members, a vertical section that projects downwardly from a distal end of said horizontal section, a hook section that projects forwardly from said vertical section for defining a hook groove and an opening formed between said hook section and said back side;

a plurality of latch members each having a longitudinal handle portion, and two arm portions which extend transversely from said longitudinal handle portion in opposite directions to engage, respectively, said clasp members of one of said pairs of said clasp members.

2. The form assembly according to claim 1, further comprising an insert form piece which includes an insert part to be inserted between said form members in an edge-to-edge contiguity, and a back part formed rearwardly of said insert part, said back part having a width larger than that of said insert part and extending over portions of said back sides of said form members, said back part engaging frictionally said arm portions, thereby holding tightly said insert form piece between said form members.

3. The form assembly according to claim 1, wherein each of said form members includes a vertical reinforcing plate mounted securely to said back side thereof, each of said clasp members being screwed on said vertical reinforcing plate.

4. The form assembly according to claim 1, wherein each said arm portion has a polygonal cross section.

5. The form assembly according to claim 1, wherein said vertical edges are cut at an angle to facilitate closure of said vertical form members when adjacent form members abut each other.

6. The form assembly according to claim 1, wherein a plurality of pairs of clasp members are positioned on said back side of said form members for cooperating with respective latch members for securing adjacent form members together.

7. The form assembly according to claim 1, wherein the two arms of each latch member includes a quadrilateral cross section.

8. The form assembly according to claim 1, wherein the two arms of each latch member have a width and a thickness, said opening in said clasp members includes a width that is greater relative to the thickness of said two arms, wherein said two arms may be disposed adjacent to corresponding clasp members and said handle may be rotated in a downwardly direction to engage said two arms within the openings in said clasp members.

9. The form assembly according to claim 8, wherein said two arms frictionally engage corresponding clasp members and a section of the back side of said form members for retaining said form members relative to each other.

10. A form assembly comprising:

at least two vertical form members being adapted to be positioned adjacent to each other in a common plane, each of said form members including a concrete forming front side, an opposite back side, and a vertical edge;

clasp members mounted respectively adjacent to said back sides of said form members along said vertical edges, said clasp members being aligned horizontally with each other, each of said clasp members includes a horizontal section extending rearwardly from said back side of each of said form members, a vertical section that projects downwardly from a distal end of said horizontal section, a hook section that projects forwardly from said vertical section for defining a hook groove and an opening formed in said clasp member adjacent to said hook groove;

a plurality of latch members each having a longitudinal handle portion, and two arm portions which extend transversely from said longitudinal handle portion in opposite directions to engage, respectively, said clasp members of one of said pairs of said clasp members.

11. The form assembly according to claim 10, and further comprising an insert form piece which includes an insert part to be inserted between said form members in an edge-to-edge contiguity, and a back part formed rearwardly of said insert part, said back part having a width larger than that of said insert part and extending over portions of said back sides of said form members, said back part engaging frictionally said arm portions, thereby holding tightly said insert form piece between said form members.

12. The form assembly according to claim 10, wherein each of said form members includes a vertical reinforcing plate mounted securely to said back side thereof, said clasp members being mounted on said vertical reinforcing plate.

13. The form assembly according to claim 10, wherein each said arm portion has a polygonal cross section.

14. The form assembly according to claim 10, wherein said vertical edges are cut at an angle to facilitate closure of said vertical form members when adjacent form members abut each other.

15. The form assembly according to claim 10, wherein a plurality of pairs of clasp members are positioned on said back side of said form members for cooperating with respective latch members for securing adjacent form members together.

16. The form assembly according to claim 10, wherein the two arms of said latch member includes a quadrilateral cross section.

17. The form assembly according to claim 10, wherein the two arms of each latch member have a width and a thickness, said opening in said clasp members includes a width that is greater relative to the thickness of said two arms, wherein said two arms may be disposed adjacent to corresponding clasp members and said handle may be rotated in a downwardly direction to engage said two arms within the openings in said clasp members.

18. The form assembly according to claim 17, wherein said two arms frictionally engage corresponding clasp members and a section of the back side of said form members for retaining said form members relative to each other.

* * * * *